United States Patent [19]

Nakamura et al.

[11] Patent Number: 4,974,780

[45] Date of Patent: Dec. 4, 1990

[54] ULTRASONIC FUEL INJECTION NOZZLE

[75] Inventors: Hiromi Nakamura; Kakuro Kokubo; Daijiro Hosogai, all of Saitama; Yutaka Ogawa, Tokyo; Masuhiro Wada, Tokyo; Fumio Yokota, Tokyo, all of Japan

[73] Assignees: Toa Nenryo Kogyo K.K.; Oval Engineering Co., Ltd., both of Tokyo, Japan

[21] Appl. No.: 367,840

[22] Filed: Jun. 19, 1989

[30] Foreign Application Priority Data

| | | | |
|---|---|---|---|
| Jun. 22, 1988 | [JP] | Japan | 63-83069 |
| Jun. 22, 1988 | [JP] | Japan | 63-155952 |
| Oct. 28, 1988 | [JP] | Japan | 63-140968 |

[51] Int. Cl.[5] ..... B05B 1/08

[52] U.S. Cl. ..... 239/102.2; 239/585

[58] Field of Search ..... 239/102.2, 585

[56] References Cited

U.S. PATENT DOCUMENTS

| | | | |
|---|---|---|---|
| 3,400,892 | 9/1968 | Ensminger | 239/102.2 |
| 4,385,339 | 5/1983 | Takada et al. | 239/585 X |
| 4,783,003 | 11/1988 | Hirabayashi et al. | 239/102.2 |

*Primary Examiner*—Andres Kashnikow
*Assistant Examiner*—William Grant
*Attorney, Agent, or Firm*—Jordan and Hamburg

[57] ABSTRACT

An ultrasonic fuel injection nozzle comprises a generator for generating ultrasonic vibrations, a vibrator secured to the ultrasonic vibration generator and a valve for supplying fuel to the vibrator. The vibrator is secured to the ultrasonic vibration generator at one end and is formed with a cavity in its other end portion for atomizing fuel therein. The vibrator has a fuel passage communicating with the interior of the cavity. A valve is provided for normally closing the passage and for opening the passage to discharge an amount of fuel depending upon the passage opening duration. A fuel atomizing portion serves to reduce the discharged fuel to minute particles through the effect of ultrasonic vibrations.

16 Claims, 6 Drawing Sheets

(A)

(B)

ULTRASONIC FUEL INJECTION NOZZLE

BACKGROUND OF THE INVENTION

The present invention relates to a fuel injection device for an internal combustion engine such as an automobile engine or the like and, more particularly, to the construction of an ultrasonic fuel injection nozzle provided with a function for ultrasonically atomizing liquid fuel to be injected into a gasoline engine.

Development of internal combustion engines has been directed towards increasing their performance and efficiency in relation to fuel economy and combustion efficiency and with due consideration to the regulation of exhaust fumes. For instance, in order to obtain an optimum air-fuel ratio in automobile engines, the tendency to adopt fuel injection methods instead of carburetor methods has been observed. In this connection new fuel vaporizers with electronic controls based on the high accuracy of air flow measurements have been developed and further adapted to a total computer control system for ignition timing, knocking, EGR (Exhaust Gas Recirculation) and other engine dynamic parameters. The improvement of engines has advanced through step-by-step improvement in each of the engine's dynamic characteristics.

A fuel injection nozzle is a device that injects liquid fuel in quantities adapted to the measured value of the suction air flow. Quantities of fuel are proportional to the valve opening duration i.e. fuel is discharged with a constant pressure through a fixed valve opening determined by a control signal during the valve opening duration defined by ON-OFF control signals. Furthermore, for increasing efficiency of the fuel's burning, attempts have been made to improve the shape of an injection port and/or a needle of the injection valve in order to produce a shearing force to the fuel being injected. Recently, fuel injection nozzles with ultrasonic atomization have also been proposed. An example of such a nozzle is described in the Japanese laid open patent publication No. 70656/87. A fuel injection nozzle disclosed in the above-mentioned laid open patent publication, basically, composed of a fixed needle and a vibrator which, being provided with a valve functioning in association with said needle, may shut off and spout a flow of fuel into the needle and then atomize the injected fuel by the action of ultrasonic vibrations. The needle is a cylinder which has a top flange with a fuel feeding opening to be connected with a fuel-feeding means, a fuel passage with a filter inserted therein for cleaning the fuel, an annular through-hole communicating with the top end of the fuel passage and with the outside of the needle, and a needle valve integrally formed at the tip end. The vibrator, in which the needle is loosely fitted with the preferable clearance of about 20 microns, has an upper side flange whereto an ultrasonic vibration generating means, being composed of a ring-shaped piezoelectric element, is fixed by the use of a nut, and has at its lower part a center injection hole, an outwardly enlarged, multi-stepped opening and a valve seat abutting onto the needle valve. The housing, enclosing a vibrator with a needle loosely inserted therein is screwed to the threaded portion of the flange of the needle. A spring means for pressing the vibrator to the needle to make the needle normally closed is interposed between the lower surface of the flange of the vibrator and the shoulder part of the housing near the injection port. A means for generating an attracting force, which is composed of ring-shaped laminated piezoelectric elements which are insulated from the needle by a kind of insulation, is placed between the upper surface of the nut of the vibrator and the lower surface of the flange. When a pulse signal of voltage is applied to the attracting force generating means, the vibrator, against the force of the spring means, moves downward to open the valve. When the valve is opened, the fuel, having flowed into the vortex chamber from the passage through the annular through-hole, spouts out through the injection port and flows laminatedly through the stepped-hole and is atomized by virtue of the vibrations produced by the vibrator during an ultrasonic signal being applied to the ultrasonic vibration generating means.

The application of an ultrasonic signal to the ultrasonic vibration generating means may be synchronized or done at different times with relation to the application of pulsating voltage to the attracting force generator. The above-mentioned "prior art" has some problems as shown by the following:

The first problem is with the laminated piezoelectric element used in the attraction force generating means since it has a higher response in comparison with the generally used electromagnetic means such as an exiting coil for generating an attraction force. However, since the above-mentioned vibrating system is related to the mass of the vibrator and the elasticity of the spring means, the basic condition for improving the response speed of the system is to reduce the mass of the vibrator. However, the vibrator is a large-sized cylinder having a needle loosely inserted therein and a stepped portion that brings a result contrary to the above-mentioned purpose.

The second problem is that, the vibrator may be driven synchronously or with a certain time-difference in relation to the ultrasonic vibration generation, however, since the vibrator, if being of large mass, may have a delay in motion, it is rather difficult to practically synchronize the vibrator's drive with the ultrasonic vibration generator's drive. Consequently, in case of low speed operation of the device it becomes impossible to ultrasonically drive the vibrator in time to effectively atomize the fuel.

The third problem relates to the method for adjusting the force of the pressure of the spring means. To improve the response speed of the ultrasonic vibrating system it is also necessary to adjust the force of the spring means to an optimum value. In a conventional device, a means for adjusting the spring's force is a threaded portion by which the spring's force cannot correctly be adjusted.

The fourth problem is that a displacement of the vibrator by the action of the attraction force generating means is decided by the voltage being applied to the piezoelectric element. Since the piezoelectric constant may vary in accordance with the temperature of the element, the above-mentioned method cannot assure the correct opening of the valve i.e. the flow curve is correctly proportional to the width of the pulse signal applied to the element.

Furthermore in the Japanese laid open patent publication No. 222552/85 a method is disclosed where liquid fuel is pulverized into fine particles by forcing the fuel through a vibrator being driven by ultrasonic waves. Ultrasonic atomization of liquid fuel may be done in such a way that liquid fuel is periodically fed into an atomizing chamber with the continuous excitation of ultrasonic vibrators or with synchronous periodical excitation of ultrasonic vibrators. For example, in the case of using an ultrasonic atomizing unit as shown in the Japanese laid open patent publication No. 222552/85 for injecting atomized fuel into an internal engine, it is shown that fuel is periodically fed into an atomizing chamber wherein vibrations are continuous. Furthermore, in the Japanese laid open patent publication No. 138557/86, an electromagnetic ultrasonic injection nozzle is proposed which is based upon that shown in the Japanese laid open patent publication No. 222552/85. The above-mentioned electromagnetic ultrasonic injection nozzle comprises an ultrasonic generator, a slender vibrator connected at one end to said ultrasonic generator and having an edge portion at its other end, said vibrator being loosely inserted into a housing, a hollow needle valve having a core integrally fixed to its upper end and being slidably fitted on said vibrator so as to be positioned near the edge portion of the vibrator, a fuel passage for supplying liquid into the edge portion, a spring means pressing said hollow needle valve to normally keep said passage closed, an electromagnetic means for exerting the core to move the hollow needle valve against the force of the spring means and thereby to open the passage, and a stopper abutting an annular slot of the hollow needle valve and defining the limits of the movement of said hollow needle valve by an axial clearance between the stopper and said annular slot of the needle valve. The quantity of liquid fuel flowing into the edge portion through the open passage is proportional to the duration of time for keeping the electromagnetic means energized. The vibrator is fixed at one end with a mounting plate which serves a node of the vibration system and has the edge portion at its other end to create ultrasonic vibrations. Liquid fuel is subjected to atomization by ultrasonic vibrations and directed to a combustion chamber.

In the above-mentioned prior art, the fixed quantity of liquid fuel, which is proportional to the energized duration of the electromagnetic means, may be introduced into the edge portion of the vibrator by maintaining a constant pressure of fuel to be supplied through the passage. Since the movement (mass) of the hollow needle valve together with the spring force of the spring means and the electromagnetic force of the electromagnetic means form the secondary vibration system, to realize a quick-response of the movement of the hollow needle valve it is necessary to adjust the pressure of the spring means. However, the prior art does not show any adjusting means. For the practical use of the ultrasonic fuel injection nozzle it is necessary to provide a means to adjust the spring force of the spring means.

SUMMARY OF THE INVENTION

It is an object of the present invention to provide an ultrasonic fuel injection nozzle with a response speed increased by reducing the size and mass of its moving parts.

It is another object of the present invention to provide an ultrasonic fuel injection nozzle having a spring means easily adjustable to the optimum force.

It is another object of the present invention to provide an ultrasonic fuel injection nozzle which comprises a means to generate ultrasonic vibrations and a vibrator secured to said ultrasonic generating means at one end and having a cavity in its other end portion for atomizing the fuel therein, characterized by forming within said vibrator a fuel passage communicating with the interior of the end cavity, by mounting therein a valve means for normally closing the passage and for opening the passage to discharge an amount of fuel depending upon the duration of the passage opening and by adding a fuel-atomizing portion for reducing the discharged fuel to minute particles through the action of ultrasonic vibrations.

It is another object of the present invention to provide an ultrasonic fuel injection nozzle in which a fuel injection means and a fuel atomizing means separated from each other and secured internally to an external housing so as to create a high performance fuel injection nozzle which has a higher effectiveness of ultrasonic vibration without affecting the fuel injection means and also has a higher response speed of the fuel injection system as a result of the reduction in size of said system.

It is another object of the present invention to provide a fuel injection nozzle equipped with an adjusting means to easily adjust the force of a spring means to obtain the optimum valve functioning of plug.

BRIEF DESCRIPTION OF THE DRAWINGS

FIG. 2 (A) is a sectional side view of the nozzle and FIG. 2 (B) is a cross section taken on line B—B in FIG. 2 (A);

FIG. 6 is a sectional side view of the nozzle and FIG. 7 is a front view taken in the direction of the arrows Y;

DESCRIPTION OF THE PREFERRED EMBODIMENTS

Figure 1:
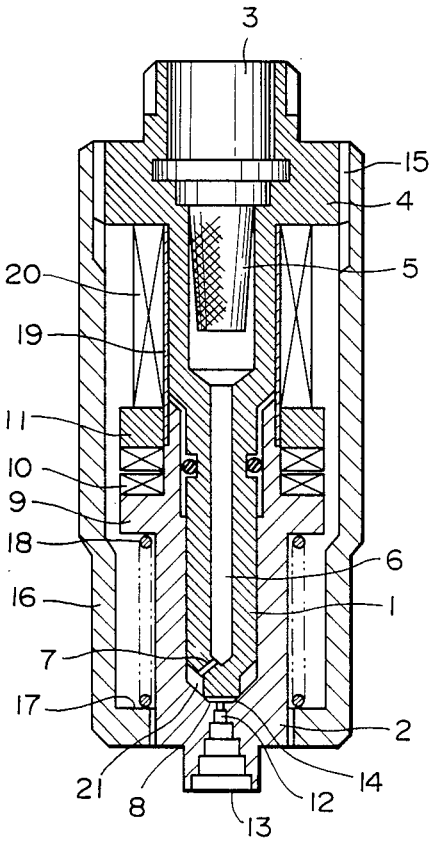
FIG. 1 (PRIOR ART)
FIG. 1 shows an example of a conventional prior art ultrasonic fuel injection nozzle.

FIG. 1 is a view showing a fuel injection nozzle disclosed in the Japanese laid open patent publication No. 70656/87. The device is basically, composed of a fixed needle 1 and a vibrator 2 which, being provided with a valve functioning in association with said needle 1, may shut off and spout a flow of fuel into the needle and then atomize the injected fuel through the action of ultrasonic vibrations. The needle 1 is a cylinder which has a top flange 4 with a fuel feeding opening 3 to be connected with a fuel-feeding means not shown in FIG. 1, a fuel passage 6 with a filter 5 inserted therein for cleaning the fuel, an annular through-hole 7 communicating the top end of the fuel passage 6 with the outside of the needle and a needle valve 8 integrally formed at the tip end. The vibrator 2, in which the needle 1 is loosely fitted with the preferable clearance of about 20 microns, has an upper side flange 9 whereto an ultrasonic vibration generating means 10, being composed of a ring-shaped piezoelectric element, is fixed by the use of a nut 11, and has at its lower part a center injection hole 12, an outwardly enlarged, multi-stepped opening 13 and a valve seat 14 abutting onto the needle valve 8. The housing 16, enclosing the vibrator 2 with a needle loosely inserted therein is screwed to the threaded portion 15 of the flange 4 of the needle 1. A spring means 18 for pressing the vibrator 2 to the needle 1 to make the needle 1 normally closed is interposed between the lower surface of the flange 9 of the vibrator 2 and the shoulder part 17 of the housing 16 near the injection port 12. A means 20 for generating an attracting force, which is composed of ring-shaped laminated piezoelectric elements which are insulated from the needle by a kind of insulation 19, is placed between the upper surface of the nut 11 of the vibrator 2 and the lower surface of the flange 4. When a pulse signal of voltage is applied to the attracting force generating means 20, the vibrator 2, against the force of the spring means 18, moves downward to open the valve. When the valve is opened, the fuel, having flowed into the vortex chamber 21 from the passage 6 through the annular throughhole 7, spouts out through the injection port 12 and flows laminatedly through the stepped-hole 13 and is atomized by virtue of the vibrations produced by the vibrator 2 during a ultrasonic signal being applied to the ultrasonic vibration generating means 10. The above-mentioned "prior art" has some problems as shown by the following:

The first problem is with the laminated piezoelectric element used in the attraction force generating means 20 since it has a higher response in comparison with the generally used electromagnetic means such as an exiting coil for generating an attraction force. However, since the above-mentioned vibrating system consists of mass of vibrator 2 and the elasticity of the spring means 18, the basic condition for improving the speed of the response of the system is to reduce the mass of the vibrator 2. However, the vibrator 2 is a large-sized cylinder having a needle 1 loosely inserted therein and a stepped portion 13 that brings a result contrary to the above-mentioned purpose.

The second problem is that, the vibrator 2 may be driven synchronously or with certain time-difference in relation to the ultrasonic vibration generating means 10, however, since the vibrator 2, if being of a large mass, may have a delay in motion, it is rather difficult to practically synchronize the vibrator's drive with the ultrasonic vibration generator's drive. Consequently, in case of low speed operation of the device it becomes impossible to ultrasonically drive vibrator 2 in time to effectively atomize the fuel.

The third problem relates to the method for adjusting the force of the pressure of the spring means 18. To improve the response speed of the ultrasonic vibrating system it is also necessary to adjust the force of the spring means to an optimum value. In the conventional device shown in FIG. 1, a means for adjusting the spring's force is a threaded portion 15 by which the spring's force cannot correctly be adjusted.

The fourth problem is that a displacement of the vibrator 2 by the action of the attraction force generating means 20 is decided by the voltage being applied to the piezoelectric element. Since the piezoelectric coefficient may vary in accordance with the temperature of the element, the above-mentioned method cannot assure the correct opening of the valve i.e. the flow curve being correctly proportional to the width of the pulse signal applied to the element.

Figure 2:
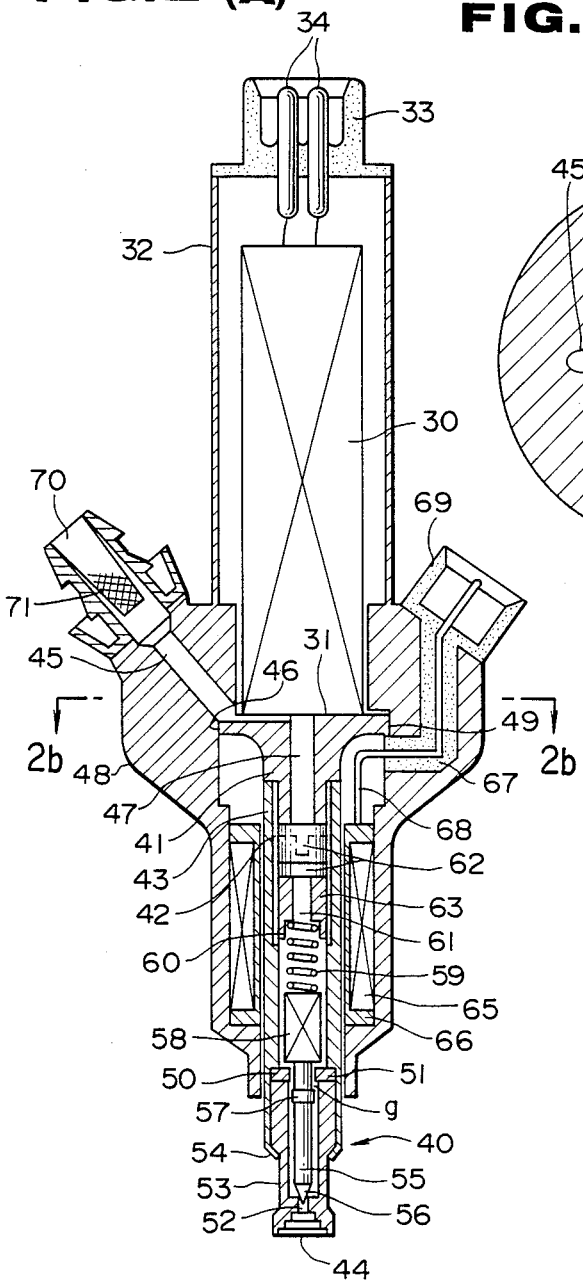
FIG. 2 is a view for explaining an ultrasonic fuel injection nozzle embodying the present invention.
Figure 2:
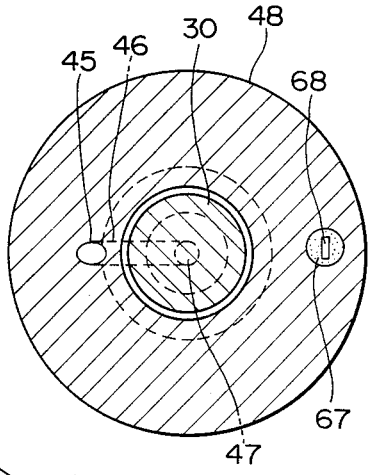

FIG. 2 is a view for explaining an ultrasonic fuel injection nozzle embodying the present invention: FIG. 2 (A) is a sectional side view of the nozzle and FIG. 2 (B) is a cross section taken on line B—B in FIG. 2 (A).

The embodiment shown in FIG. 2 is intended to increase the response speed of the system by reducing the size and mass of its moving parts and consequently to make the spring means be easily adjustable to the optimum force, more particularly, it is intended to provide an ultrasonic fuel injection nozzle which comprises a means to generate ultrasonic vibrations and a vibrator secured at its one end to said ultrasonic vibration generating means and having a cavity in its other end portion for atomizing the fuel therein, characterized by forming within the vibrator a fuel passage communicating with the interior of the end cavity, by mounting therein a valve means for normally closing the passage and for opening the passage to discharge an amount of fuel depending upon the duration of the passage opening and by adding a fuel-atomizing portion thereby reducing the discharged fuel to minute particles through the effect of ultrasonic vibrations.

In FIG. 2, 30 is a cylindrical ultrasonic vibration generator consisting of piezoelectric elements and secured at its bottom surface 31 to a vibrator 40. The vibrator 40 is a tubular unit which is composed of a horn portion 41 forming a part of an ultrasonic vibration horn, an external tube 43 with a thread 42 engaging said horn portion 41 and a valve means (to be explained later) being mounted in said external tube 43 and having an edge portion 44 in the case of the shown embodiment. The horn portion 41, having fuel passages 46 and 47 respectively in radial and axial directions thereof, is connected at its circular top surface to the ultrasonic vibration generator 30 and secured to a housing 48 by a caulked seam (not shown) of its lower periphery 49. The external tube 43 of the vibrator has a lower side opening of a larger diameter forming a circular shoulder 50 at its inner wall. In said lower portion of the tube, a stopper ring 51 is inserted to abut on the shoulder 50 thereof and a nozzle body 53 having an upper cavity, a lower injection port 52 forming a valve seat and the edge portion 44 (provided with a multi-stepped hole in case of the shown embodiment) is also inserted to abut on the lower surface of the stopper ring. The external tube 43 is secured to the nozzle body 53 by inwardly locking its end 54 thereto. A needle 55 is loosely and axially inserted in the nozzle 53 and serves as a valve abutting on the valve seat 56 of the nozzle body 53. The needle 55 has a ring 57. A clearance "g" between said ring 55 and the stopper ring 53 can be correctly adjusted to the necessary value by selecting the proper thickness of the stopper ring 51. A cylindrical yoke head 58 is firmly fitted on the top of the needle 55. A spring means 59 abuts at one end on said yoke head 58 of the nozzle body and is also fitted at its other end in a recess 60 of an adjusting means 63 which has a fuel passage 61 axially drilled therethrough and is provided with an external thread to engage with the internal thread 42 of the external tube 43 of the vibrator and also provided with a turning recess 62 for a screw-driver or the like. The spring means 59 fixed at its end to the adjusting means 63 thus presses the needle 55 against the valve seat of the nozzle body 53 to keep the injection port closed. The force of the spring means 59 can be adjusted by turning the adjusting means. The valve means is composed of the above-mentioned nozzle body 53, needle 55, spring means 59 and adjusting means 63 and is removably inserted together with the horn portion 41 in the external tube 43 of the vibrator. Furthermore, in the housing 48 an electromagnetic means 65 is provided so that it may surround the middle portion of said vibrator's external tube 43 keeping a fine even radial clearance thereat. Said electromagnetic means 65 is intended to force the needle to travel the distance "g" to open a port in the valve seat 56 by electromagnetically attracting the yoke 58 against the force of the spring means 59. The electromagnetic means 65 is composed of a coil wound around a bobbin 66 and incorporated into the housing 48. Its lead wire 68 is insulated with insulating material 67 and terminated in a connector 69 for connecting with a driving means not shown in FIG. 2. When a pulse signal is fed from the driving means, the electromagnetic means 65 is excited and retracts the needle 55 to open the injection port for the period of time proportional to the pulse width. At this time a certain quantity of fuel, which is defined in proportion to the valve opening duration, flows through the fuel feeding port 70, the filter 71, the passages 45, 46, 47, 61 and the space formed between the nozzle body 53 and the needle 55 and discharged out from the injection port 52. When electric power from a power source (not shown) is supplied to a terminal 34 of a connector 33 at one end of a protecting tube 32 secured to the housing 48, the ultrasonic vibration generator 30 in said protector tube 32 is excited and applies ultrasonic vibrations to the vibrator 40 which in turn creates vibrations with a node at the periphery 49 of the horn 41, where the housing 48 is connected, and with a loop at the edge portion 44 or in the neighborhood. Fuel emitted from the injection port 52 is atomized by the effect of ultrasonic vibrations in the course of further flowing through passages in the edge portions 44 and then dispersedly spouts out. In this embodiment, although the needle 55 has a cone-shaped end at the side of the atomizing portion, it is to be understood that the form of the needle's end is not limited to the cone and may be modified freely within the scope of the present invention concepts. Furthermore, as disclosed by one of the present applicants in Japanese laid open patent publication No. 222552/85, the needle may be formed with circumferential inclined grooves near its tip end to guide the flow of fuel with swirling into the atomizing portion.

Figure 3:
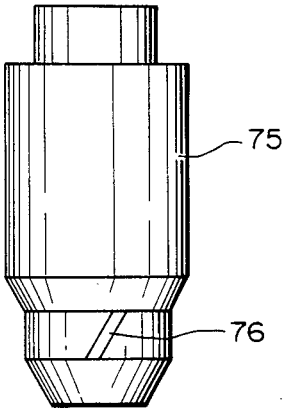
FIG. 3 (PRIOR ART)
FIG. 3 shows an example of a needle valve.

FIG. 3 is a view showing an example of swirl generating means disclosed in the Japanese laid open patent publication No. 222552/85. As shown in FIG. 3, by applying a hollow needle valve having plural, for example, of two inclined groove 76 formed diagonally at its portion of smaller diameter, it is possible to create a turbulence of fuel in a passage resulting in that fuel swirling and thereby being injected evenly (not partially). Such a design of the needle also assures a higher accuracy of the fuel's flow and the fineness of the fuel's atomization. By increasing the number of steps for an opening in the edge portion 44 and by selecting the length of the passage under the valve seat 56 it becomes possible to put a nodal point for the vibration system at the valve seat 56 and thereby to continuously apply ultrasonic vibrations to the vibrator 40 that reduces the load of the ultrasonic drive and increases the working efficiency of the system.

In the valve means, the needle 55 and the spring means 59 also form a vibration system as previously mentioned in the prior art. According to the present invention, the spring means 59 can be adjusted by turning the adjusting means 63 by the use of a screw driver after removing the valve means from the horn portion 41 by unscrewing the external tube 43 of the vibrator. After completion of the spring force adjustment, the adjusting means 63 is locked, the external tube 43 is screwed again on the horn portion 41 and then the housing 48 is locked inwardly to the external tube 43 through a through hole (not shown) of the housing 48. It is to be understood that the present invention is not limited in its application to the construction of the atomizing portion having edges (steps) at its inner wall as shown in this embodiment and/or disclosed by one of the present applicants in the above-mentioned Japanese laid open publication No. 259780/86 but may be applicable to other atomizing portions modified in form and construction.

As is apparent from the foregoing description, in the ultrasonic fuel injection nozzle, according to the above-mentioned embodiment of the present invention, a main valve for fuel injection is incorporated into the vibrator and a needle is adopted as a moving part so as to get a higher response speed of the valve means by reducing its size and mass.

With the same reasoning, the spring means which is a part of the vibration system is so constructed that the spring force can be easily adjusted by removing the vibrator's external tube wherein the spring means and its adjusting means are mounted.

Furthermore, by setting a nodal point of ultrasonic vibrations of the vibrator at the valve seat it becomes possible to effectively operate the ultrasonic vibration system.

According to the above-mentioned embodiment it is possible to provide an ultrasonic fuel injection nozzle which is low in cost, easily adjustable, has a much improved response speed and has higher efficiency of fuel injection and atomization.

Figure 4:
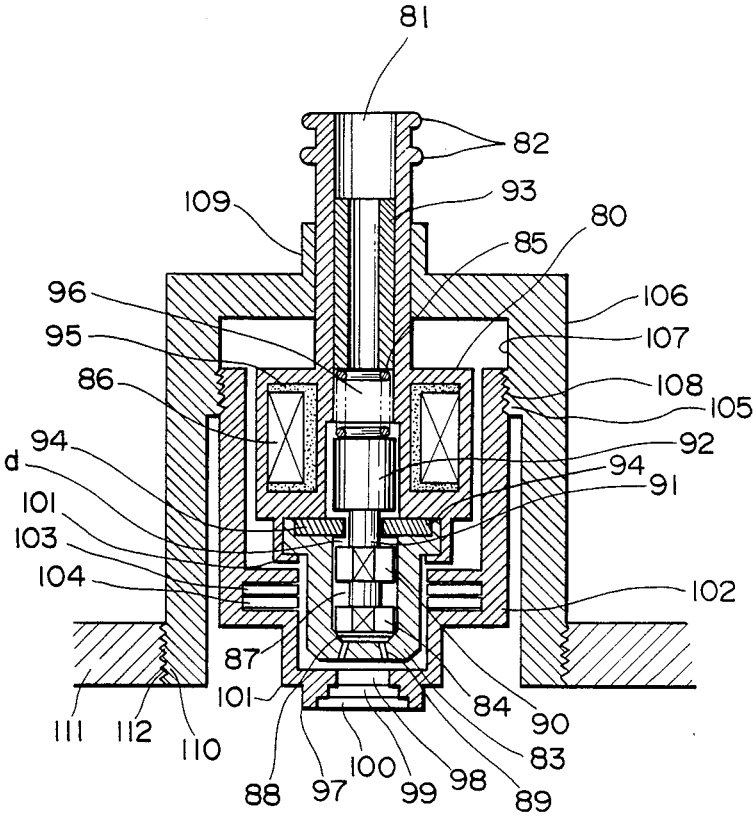
FIG. 4 is a construction view for explaining another embodiment of a fuel injection valve according to the present invention.

FIG. 4 is a view showing a construction of a fuel injection valve according to another embodiment of the present invention. In FIG. 4, a fuel injection means is composed of a casing 80 which has a feeding port 81 in its rimed end 82 to be connected to a fuel feeding means (not shown) with the use of a hose and the like and which also includes integrally formed fuel injection elements to be mentioned below. The fuel injection means is composed of a nozzle body 83, a valve body 84 loosely inserted in said nozzle body 83 to form a valve portion in association with the nozzle body 83, a spring 85 normally pressing said valve body 84 against the inner wall of the nozzle body 83 and a coil 86 which at the time of an electric current feeding through it, it electromagnetically attracts the valve body 84 to open the valve portion in the nozzle body 83 against the spring force. The nozzle body 83 of a cylindrical shape has a cavity 87 drilled therein, a valve seat 88 and a fuel injection port 89 drilled in the bottom of said cavity 87. The nozzle body is fixed to the lower end of the casing 80 by caulking or by other adequate methods. The valve body 84, loosely inserted in the cavity 87 of the nozzle body 83, forms a valve portion in association with the valve seat 88 and can move in an axial direction along a guide 90 in the cavity 87. A plunger 92 made of magnetic material is fixed to one end of the rod 91 of the valve body 84. Consequently, the plunger 92 moves together with the valve body 83. The spring 85 abuts at its one end on the end of the plunger 92 to normally force the valve body 84 against a valve seat 88 of the nozzle body 84. The spring 85 abuts at its other end on the face of a spool 93 fitted in the fuel feeding port 81 of the casing 80. A ring-shaped stopper 94 is fitted in the top recess of the nozzle's body 83 and pressed between the nozzle body 84 and the casing 80. A distance "d" between the lower surface of said stopper 94 and the upper surface of the guide 90 corresponds to a defined micro-movement (for instance 90 microns) of the valve body 84, by which the extent of the valve opening is decided. The coil 86, wound round a bobbin 95, is placed so as to surround the plunger 92 and to attract the latter by the action of an electromagnetic force produced by the coil when being energized.

The above-mentioned fuel injection means works as follows. Fuel fed through the fuel feeding port 81 fills the internal passage including the spool 93, spring 85, the passage 96 and cavity 87. The fuel remains inside of the device while the valve body 84 closely sits on the valve seat 89. When the coil 86 is energized to electromagnetically attract the plunger 92 upwards by a micro-distance of "d", the valve is opened to allow the fuel to spout through the fuel injection port 89. The fuel is pulverized in the atomizing portion 97 which, by way of example, has an outwardly enlarged multi-stepped opening (with steps 98, 99 and 100). The steps are preferably arranged in the axial direction of the injection port 83. The fuel atomizing portion 97 is ultrasonically exited, for example, by the laminated, ring-shaped piezoelectric elements 103, 104 (with lead wires not shown) fixed at a cylindrical portion 102 of the cylindrical body 101. The ring-shaped piezoelectric elements 103 and 104 are exited from an ultrasonic oscillator not shown and vibrate in an axial direction. By the effect of the vibration energy thus produced in the atomizing portion 97, fuel is sheared to form a mist of fine particles to be introduced into a combustion chamber (not shown) of an internal combustion engine. The cylindrical body 101 surrounding the fuel injection means without touching it has an external thread 105 at its circumference to engage with an internal thread 108 on the internal cylindrical surface 107 of the housing 106. The cylindrical housing 106 holding the fuel injection means in its upper tubular portion 109 is fitted at its lower threaded portion 110 in the threaded portion 112 of an intake pipe wall 111. The cylindrical body 101 is enclosed in said housing 106. The fuel injection valve thus constructed according to the present invention may inject fuel by its fuel injection means and atomize the same by its ultrasonic atomizing means having no contact with the fuel injection means. Accordingly, no effect of ultrasonic vibrations is exerted to the fuel injection means.

As is apparent from the foregoing description, in the fuel injection valve, according to the above-mentioned embodiment, a fuel injection means and a fuel atomizing means are separated from each other and secured internally to an external housing. By adopting such a construction it becomes possible to provide a high performance fuel injection nozzle which has a higher effectiveness of ultrasonic vibrations without affecting the fuel injection means and also has a higher response speed of the fuel injection system as a result of the reduction in size of said system.

Figure 5:
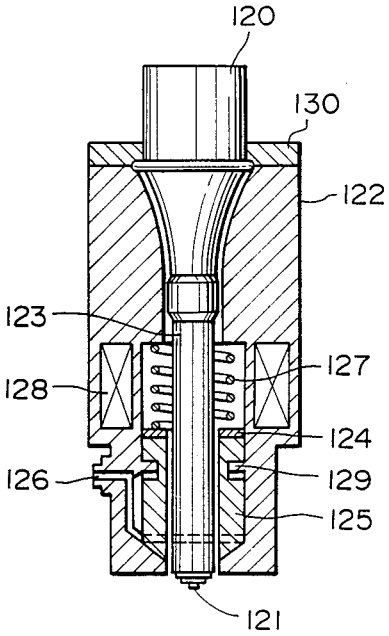
FIG. 5 (PRIOR ART)
FIG. 5 is a view for explaining an example of a conventional liquid fuel injection nozzle.

FIG. 5 is a view showing an electromagnetic ultrasonic injection nozzle disclosed in the Japanese laid open patent publication No. 138557/86. As shown in FIG. 5, the electromagnetic ultrasonic injection nozzle comprises an ultrasonic generator 120, a slender vibrator 123 connected at one end to said ultrasonic generator 120 and having an edge portion 121 at its other end, said vibrator 123 being loosely inserted into a housing 122, a hollow needle valve 125 having a core 124 integrally fixed to its upper end and being slidably fitted on said vibrator 123 so as to be positioned near the edge portion 121 of the vibrator 123, a fuel passage 126 for supplying liquid into the edge portion 121, a spring means 127 pressing said hollow needle valve 125 to normally keep said passage 126 closed, an electromagnetic means 128 for exerting the core 124 to move the hollow needle valve 125 against the force of the spring means 127 and thereby to open the passage 126, and a stopper 129 abutting an annular slot of the hollow needle valve 125 and defining the limit of the movement of said hollow needle valve 125 by an axial clearance between the stopper and said annular slot of the needle valve. The quantity of liquid fuel flowing into the edge portion 123 through the open passage 126 is proportional to the duration for keeping the electromagnetic means 128 energized. The vibrator 123 is fixed at one end on a mounting plate 130 which serves as a node for the vibration system and has the edge portion 121 at its other end to create ultrasonic vibrations. Liquid fuel is subjected to atomization by ultrasonic vibrations and directed to a combustion chamber (not shown).

In the above-mentioned prior art, the fixed quantity of liquid fuel, which is proportional to the energized duration of the electromagnetic means 128, may be introduced into the edge portion 121 of the vibrator 123 by keeping a constant pressure of fuel to be supplied through the passage 126. Since the movement (mass) of the hollow needle valve 125 together with the spring force of the spring means 127 and the electromagnetic force of the electromagnetic means 128 form the secondary vibration system, to realize a quick-response movement of the hollow needle valve 125 it is necessary to adjust the pressure of the spring means 127. However, the above-mentioned prior art does not show any adjusting means. For practical use of the ultrasonic fuel injection nozzle it was necessary to provide a means to adjust the spring force of the spring means 127.

Figure 6:
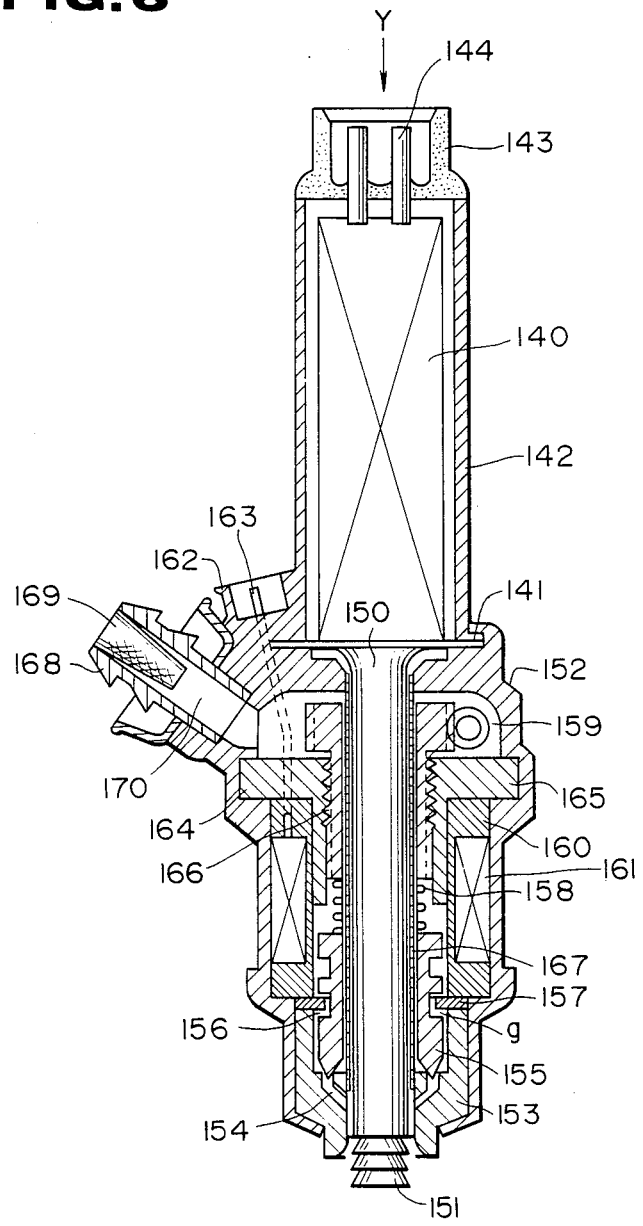
FIGS. 6 and 7 are views for explaining another embodiment of an ultrasonic fuel injection nozzle according to the present invention.
Figure 7:
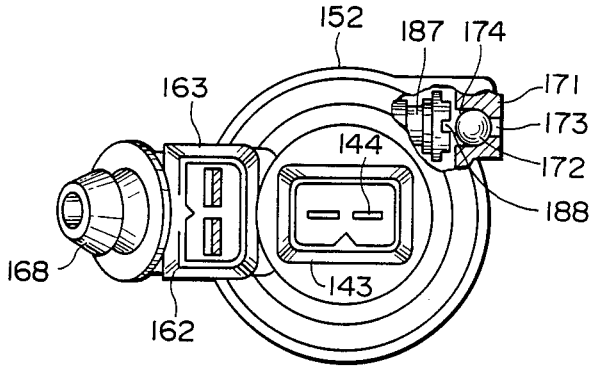

FIGS. 6 and 7 are views for explaining the construction of an ultrasonic fuel injection nozzle embodying the present invention: FIG. 6 is a sectional side view of the nozzle and FIG. 7 is front view taken in the direction of the arrows Y.

In an ultrasonic fuel injection nozzle shown in FIGS. 6 and 7, liquid fuel in quantities proportional to the pulse width (duration) is supplied and subjected to pulverization by ultrasonic vibrations to form fine particles so that it will burn more efficiently in an internal combustion engine.

The embodiment shown FIGS. 6 and 7 is intended to make the spring means be easily adjustable to an optimum force by the use of a compact and simple adjusting means and thereby to increase the response speed of the valve means to obtain a more accurate flow rate of liquid fuel.

In FIG. 6, numeral 140 designates an ultrasonic vibration generator consisting of piezoelectric elements and being secured to a mounting plate 141 and mounted in a protective tube 142. A connector 143 is air-tightly welded to an end portion of the protective tube. An ultrasonic signal is applied to the ultrasonic vibration generator 140 through terminals 144. The protecting tube and mounting plate 141 are secured to a housing 152 by caulking or other adequate methods. A vibrator 150 is secured to said mounting plate 141 which serves as a node of vibration. In this embodiment, the vibrator 150 is provided with an edge portion 151 at its lower end. The vibrator is inserted into the center tube of the housing. At this time the edge portion 151 of the vibrator 150 is projected from the lower end of the housing and forms an atomizing portion. A cylindrical valve seat 153, through which the vibrator 150 is inserted, is located in the lowest part of the housing 152. The valve seat 153 has a coaxially-drilled annular passage 154 being opened near the edge portion 151. The fuel passage 154 is opened and closed by a cylindrical plug 155 functioning cooperatively with the valve seat 153. The plug 155 has an annular recess at the circumferential center portion. A stopper ring 157 is loosely fitted in said recess 156 to form a minute clearance "g".

The plug moves within the clearance "g" and is light in weight. The whole or a part of the plug 155 is made of a magnetic material. A spring means 158 abuts at one end on the plug 155 and abuts at its other end on an adjusting means 159. Normally the plug 155 is pressed against the valve seat 153 under the spring's pressure to close the fuel passage 154.

Figure 8:
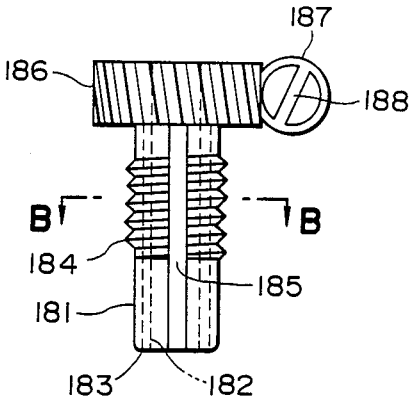
FIGS. 8 (A) and (B) detailed views of the adjusting means shown in FIG. 6.
Figure 8:
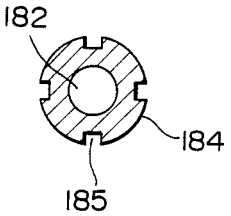

An electromagnetic means 161 composed of a coil-wound bobbin 160 is placed surrounding the spring means 158. The terminal wire 163 from the socket 162 is connected to the electromagnetic means. When the electromagnetic means 161 is energized through the terminal wire 163 of socket 162, it attracts the plug 155 by the electromagnetic power overcoming the spring's force and thereby makes the fuel passage 154 opened. The adjusting means 159 is used for adjusting the spring force of the spring means 158. FIG. 8 shows the detail of the adjusting means.

FIG. 8 (A) is a side view of the spring means and FIG. 8 (B) is a view taken along the line B—B of FIG. 8 (A).

In FIGS. 8 (A) and 8 (B), 181 is a cylindrical body with a center-through-hole 182 for inserting a vibrator 150 and with a head 183 for supporting the spring means 158. The cylindrical body 181 also has a circumferential thread 184 and a plurality of axial grooves for forming liquid fuel passages. The cylindrical body 181 has an integrally formed worm wheel 186 at its other end and a worm 187 engaging with said worm gear 186 is rotatably mounted in the housing 152. The worm 187 has a turning groove 188 on its face. The thread 184 on the cylindrical body 181 engages with the internal thread 166 of a guide member 165 fixed at its flange 164 in the housing 152. When the worm 187 is turned, the worm wheel 186 is turned causing the vertical movement of the cylindrical body 181 (in relation to the fixed guide member 165) to adjust the spring means 158. The above-mentioned adjusting means 159, spring means, plug 155 and valve seat 153 are arranged around the vibrator 150, but they are liquid-tightly separated from the vibrator 150 by a spacer tube 167 secured at one end to the housing 152 and at its other end to the valve seat 153.

Liquid fuel is supplied through a rubber hose (not shown) connected to a connecting pipe 168 with a filter 169 for cleaning off dirt. Clean liquid fuel enters into the housing 152 through a fuel inlet port 170 and flows into the grooves 185 of the adjusting mean 159 and plug 155 and then enters into the fuel passage 154. Since the opening of the plug 155 is constant, the quantity of the liquid fuel injected is proportional to the duration of the valve opening and thereby effective atomization can be carried out. Finely atomized fuel is then introduced into the combustion chamber (not shown). The spring force of the spring means 158 is adjusted by turning the worm 187 to the optimum value minimizing the lag of operation of the plug 155.

Adjustment can be made by turning the worm 187 by the use of a screw-driver or the like through an opening of the cylinder 171 located directly above the worm 187 and secured to the housing 152. After completion of the adjustment a ball 173 is introduced into the cylinder 171 through a large hole 173 and fitted into a small hole 174 and then locked in place by inwardly bending the outer part of the cylinder 171.

Although in this embodiment, the vibrator is explained as being provided with an edge portion at one end, it is to be understood that the form of the vibrator is not limited to those shown in FIG. 8 and may be modified freely within the scope of the present invention's concepts.

As is apparent from the foregoing description, an ultrasonic fuel injection nozzle, according to the present invention, is provided with an adjusting means to easily adjust the force of the spring means so as to obtain the optimum valve functioning of plug 155 and therefore it may give improved efficiency in carrying out the ultrasonic atomization of a liquid fuel.

What is claimed is:

1. An ultrasonic fuel injection nozzle comprising an ultrasonic vibration generating means, a vibrator secured at one end to said ultrasonic vibration generating means and having a fuel atomizing portion at its other end and a housing having a fuel inlet port and containing therein a plug being movable within a minute defined distance to and from a tubular valve seat having a fuel passage therethrough, said passage being coaxial with the vibrator and open near the atomizing portion, a spring means pressing said plug against said valve seat, an adjusting means abutting on one end of said spring means to adjust the pressure of said spring, an electromagnetic means liquid-tightly sealed for attracting the plug against the spring-force of the spring means, characterized in that the adjusting means is provided with a circumferential thread at one end abutting on the spring means and with a tubular head having a coaxial worm wheel and a worm at its other end and adjustable by turning the worm through an adjustable port provided in the housing and said adjustable port being liquid-tightly closed after the adjustment of the worm.

2. An ultrasonic fuel injection nozzle comprising a housing means having a fuel inlet, a vibrating means disposed in said housing means, ultrasonic vibration generator means mounted on said housing means and operable to effect vibration of said vibration means, said vibrating means comprising a structure means having a fuel discharge outlet and an axial passage communicating said fuel inlet with said fuel discharge outlet, said vibrating means further comprising a valve means axially movable in said passage between open and closed positions, said vibrating means further comprising spring means in said passage biasing said valve means toward said closed position, said vibrating means further comprising adjustment means in said passage and cooperable with said structure means for adjusting the biasing force with which said spring means biases said valve means toward its closed position, and electromagnetic means mounted in said housing means and operable upon being energized to move said valve means to said open position, whereby said vibrating means is vibrated by said ultrasonic vibrating generator means to atomize said fuel when said valve means is in said open position and said fuel is discharged past said open valve means through said fuel discharge outlet.

3. An ultrasonic fuel injection nozzle according to claim 2, wherein said structure means has a valve seat on which said valve means sits when said valve means is in said closed position, said valve seat being located at said fuel discharge outlet, said valve means comprising an elongated needle valve member axially slidable in said passage, said vibrating means further comprising a stop means on said structure means engageable with said needle valve member for defining the amount of movement of said valve member between said open and closed positions, said vibrating means having an outer periphery, said electromagnetic means being disposed about said outer periphery of said vibrating means.

4. An ultrasonic fuel injection nozzle according to claim 2, wherein said vibrating means further comprises a horn portion removeably fastened to said structure means, said adjusting means comprising a threaded member threaded to said structure means and having a slot for receiving a screwdriver to effect said adjustment of said biasing force of said spring means, said slot being accessible upon removing said horn portion from said structure means.

5. An ultrasonic fuel injection nozzle according to claim 4 further comprising thread means removeably fastening said horn portion to said structure means.

6. An ultrasonic fuel injection nozzle according to claim 2, wherein said structure means comprises an elongated tube having a central longitudinal axis, said structure means further comprising a nozzle body mounted on said tube, said nozzle body having an elongated passage having a central longitudinal axis coincident with said central longitudinal axis of said tube, said nozzle body having a valve seat, said valve means comprising an elongated needle valve member having a central longitudinal axis coincident with said central longitudinal axis of said elongated passage of said nozzle body, said needle valve member being moveable in said elongated passage to engage said valve seat when said valve means is in said closed position.

7. An ultrasonic fuel injection nozzle according to claim 6 wherein said tube has an inside, said adjusting means comprising an adjusting member threaded to said inside of said tube, said adjusting member having an axial passage coaxial with said central longitudinal axis of said elongated tube.

8. An ultrasonic fuel injection nozzle according to claim 7, wherein said adjusting member has one longitudinal end which abuts said spring means.

9. An ultrasonic fuel injection nozzle according to claim 6, wherein said electromagnetic means is disposed about said tube.

10. An ultrasonic fuel injection nozzle according to claim 2, wherein said vibrating means has a node portion at said valve seat.

11. A fuel injection nozzle comprising a housing means, a structure means mounted on said housing means, said structure means having a passageway leading from a fuel inlet to a fuel discharge outlet, said structure means further comprising a valve means axially movable in said passage between open and closed positions, said structure means further comprising spring means in said passage biasing said valve means toward said closed position, electromagnetic means mounted on said structure means and operable upon being energized to move said valve means to said open position, a cylindrical body disposed about said structure means and disposed between said structure means and said housing means, connecting means connecting said cylindrical body to said housing means, said cylindrical body having a fuel atomizing means juxtaposed to said fuel discharge outlet of said structure means, and ultrasonic vibrating means mounted on said cylindrical body operable to vibrate said atomized means such that the fuel which passes from said fuel discharge outlet through said fuel atomizing means is thereby atomized.

12. A fuel injection nozzle according to claim 11, wherein said housing means comprises a cylindrical housing member having an end wall, said end wall having a central opening, said structure means being mounted in said opening.

13. A fuel injection nozzle according to claim 12, wherein said connecting means comprises a first threaded section on said cylindrical body and a second threaded section on said housing means threaded to said first threaded section.

14. A fuel injection nozzle according to claim 12, wherein said cylindrical housing member, said cylindrical body, said valve means and said spring means all have a common central axis.

15. A fuel injection nozzle according to claim 11, wherein said fuel discharge outlet on said structure means is axially spaced from said fuel atomizing means.

16. A fuel injection nozzle according to claim 11, wherein said cylindrical body has a longitudinal axis, said cylindrical body having an end wall portion generally perpendicular to said longitudinal axis, said fuel atomizing means being disposed in said end wall portion.

* * * * *